United States Patent [19]

Eberhardt

[11] Patent Number: 4,734,019

[45] Date of Patent: Mar. 29, 1988

[54] PUMPING SYSTEM

[75] Inventor: H. Alfred Eberhardt, Paoli, Pa.

[73] Assignee: Hale Fire Pump Company, Conshohocken, Pa.

[21] Appl. No.: 938,402

[22] Filed: Dec. 5, 1986

[51] Int. Cl.[4] ..... F04B 39/00; F01D 25/16

[52] U.S. Cl. ..... 417/440; 415/116; 415/169 R

[58] Field of Search ..... 417/440; 415/169 R, 415/176, 116

[56] References Cited

U.S. PATENT DOCUMENTS

| | | | |
|---|---|---|---|
| 4,128,362 | 12/1978 | Sheppard | 415/176 |
| 4,432,442 | 2/1984 | Vogelsang | 415/169 R |
| 4,502,834 | 3/1985 | Jackson | 415/116 |

*Primary Examiner*—William L. Freeh

*Attorney, Agent, or Firm*—Frank A. Follmer

[57] ABSTRACT

A pumping system employing a main pump and a high pressure centrifugal pump both of which are driven by an engine through a suitable drive is provided with an air clutch device whereby air is selectively introduced into the inlet of the high pressure centrifugal pump to cause air binding of the impellers, this action causing a de-clutching of the high pressure pump by a simple hydraulic action.

14 Claims, 8 Drawing Figures

PUMPING SYSTEM

BACKGROUND AND SUMMARY OF THE INVENTION

This invention relates to a pumping system of the type employing a main pump and a high pressure centrifugal pump both of which are driven by an engine through a suitable drive means. In some applications, such as a pumping system used for firefighting applications, it is necessary to engage and disengage the high pressure pump from the engine drive so that all the horsepower of the engine can be delivered to the main pump. In the prior art systems, mechanical clutches are employed to engage and disengage the high pressure pump from the engine drive. However, mechanical clutches are a problem because of their relatively high failure rate which usually is caused by the system operators slipping of the clutch during the engagement of the high pressure pump. Slipping of the clutch causes the clutch facings to burn out. Also, the initial cost and replacement of the mechanical clutches involves a substantial cost.

It is the general object of the invention to provide in the pumping system of the indicated type comprising means for disengaging the high pressure centrifugal pump in a manner that is reliable and avoids the failure problems of mechanical clutches.

Another object of the invention is to provide a means for disengaging the high pressure pump by a simple manual movement of the operator so that the operator can perform the function of pump disengagement by a simple and foolproof maneuver.

Briefly stated, the general object of the invention is achieved by providing what may be termed an "air clutch" means whereby air is selectively introduced into the inlet of the high pressure centrifugal pump to cause air binding of the pump impellers, i.e., the replacement of the incompressible fluid (water) with the compressible fluid (air) at the inlet region of the impellers to prevent the build-up of pump pressure thereby rendering said pump incapable of pumping any fluid. This action, in effect, de-clutches the high pressure pump by a simple hydraulic action. Accordingly, de-clutching of the high pressure pump reduces the horsepower drag on the drive means for the main pump to a minimum so that all the engine horsepower can be directed to the main pump.

It will be apparent that the "air clutch" arrangement of the invention is very reliable and it is not subject to abuse by the operator. There are no parts that can wear out. Furthermore, the simple hydraulic system of the invention is less expensive to manufacture and maintain than a mechanical clutch system.

For example, the amount of power reduced can be seen from a typical fire pump's operating condition wherein the main pump is running at 500 GPM and a pressure of 450 psi. The unloading of the high pressure pump at this condition, by putting it in a non-pumping mode by means of the "air clutch" of the invention, will reduce the power comsumption at this particular condition from 260 to 225 horsepower.

In accordance with another feature of the invention, means are provided for cooling and lubricating the outboard sleeve bearing of the high pressure pump and the mechanical seal on the inboard side of the impeller for the high pressure pump. It is noted that even though no hydraulic work is being done by the high pressure pump impellers when they are in the non-pumping mode thereof, the pump impellers and the pump shaft are still turning whereby it is necessary to prevent damage to the seal and bearings as discussed above.

DESCRIPTION OF THE PREFERRED EMBODIMENT

Figure 1:
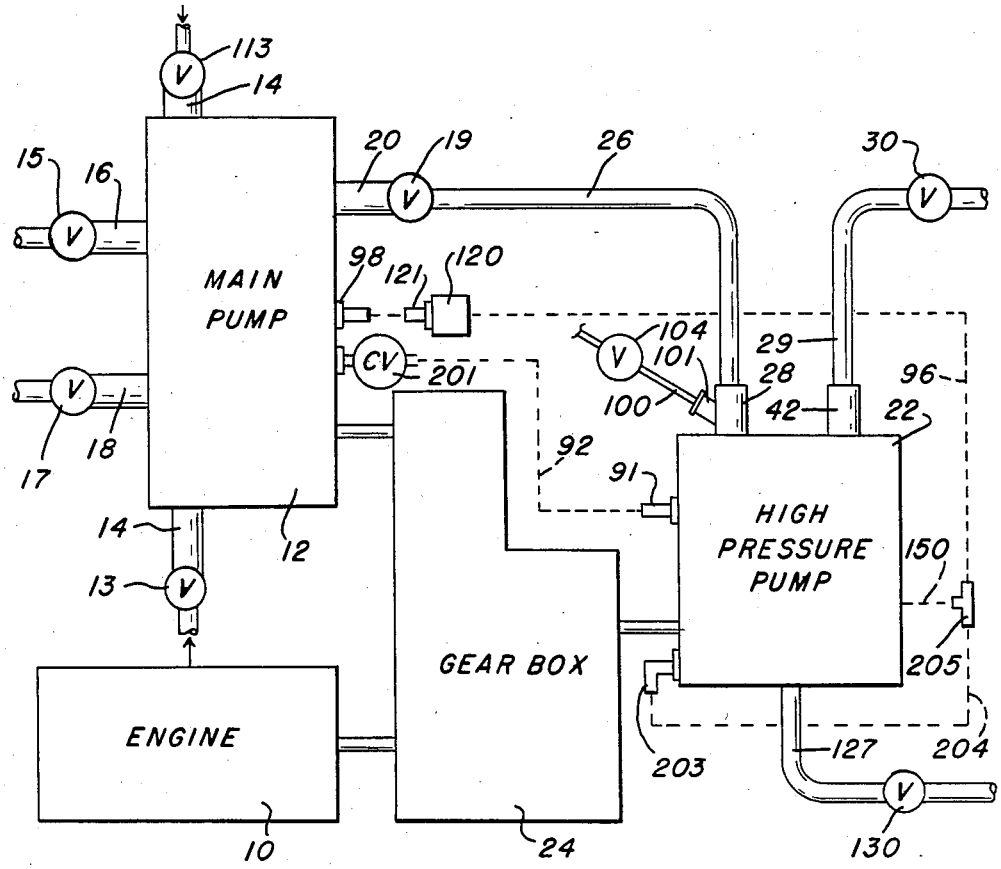
FIG. 1 is a diagrammatic view of the pumping system in accordance with the invention.

Referring to FIG. 1, there is shown, in diagrammatic form, a pumping system in accordance with the invention which comprises an engine 10, a main pump 12 having an inlet, including a pair of inlet fittings 14, and a plurality of discharges, including discharge fittings 16, 18 and 20, a high pressure pump 22, and drive means including a gearbox 24 for driving both the main pump 12 and the high pressure pump 22 from the engine 10. There are provided control valves 13 and 15, 17 and 19 for controlling flow through the inlet fittings 14 and the discharge fittings 16, 18 and 20, respectively. A main conduit means, including a hose line 26, is connected between the discharge control valve 19 and an inlet fitting 28 for the high pressure pump 22. A control valve 30 is provided in the discharge line 29 for controlling flow from the discharge of the high pressure pump 22.

The above-described parts of the pumping system are conventional (except for the discharge control valve 19) and reference is made to U.S. Pat. Nos. 4,209,282 and 4,337,830 wherein there is disclosed one type of pumping system as described above for use on a fire truck. As described in these patents, the inlet of the main pump 12 is provided by a pair of inlet tubes constructed and arranged to be connected to a water supply from either side of a fire truck and to communicate with inlet chambers at the entrance of a single stage double suction impeller for the main pump 12. The exit from the impeller of main pump 12 communicates with a main pump discharge passage which communicates with the various discharge fittings, such as fittings 16, 18 and 20. In a typical fire fighting application, fire hoses are connected to the outlet end of the discharge valves 15, 17 and 30.

Figure 2:
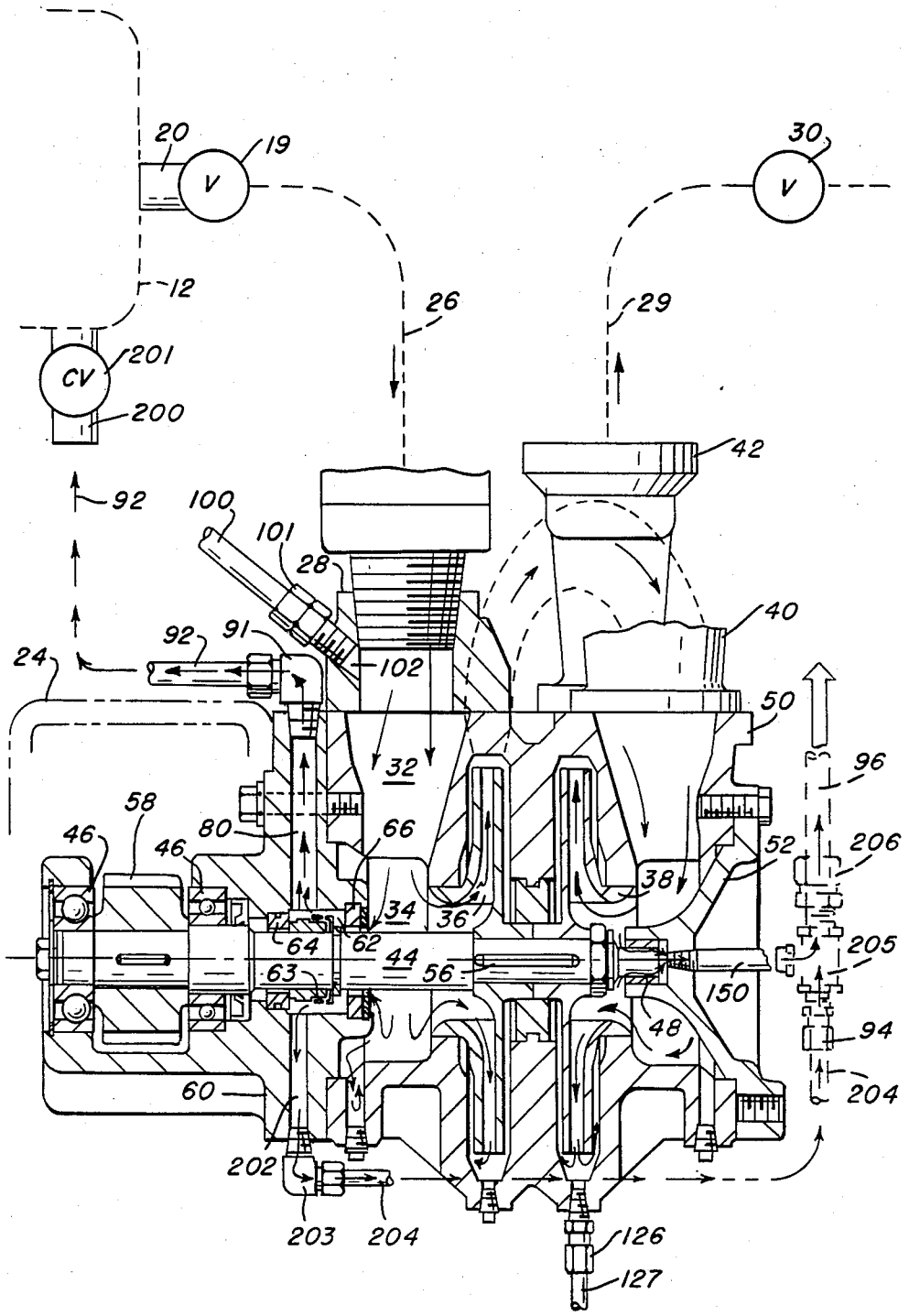
FIG. 2 is a partly diagrammatic view showing the pumping system of the invention in the pumping mode and showing the high pressure pump in section.
Figure 3:
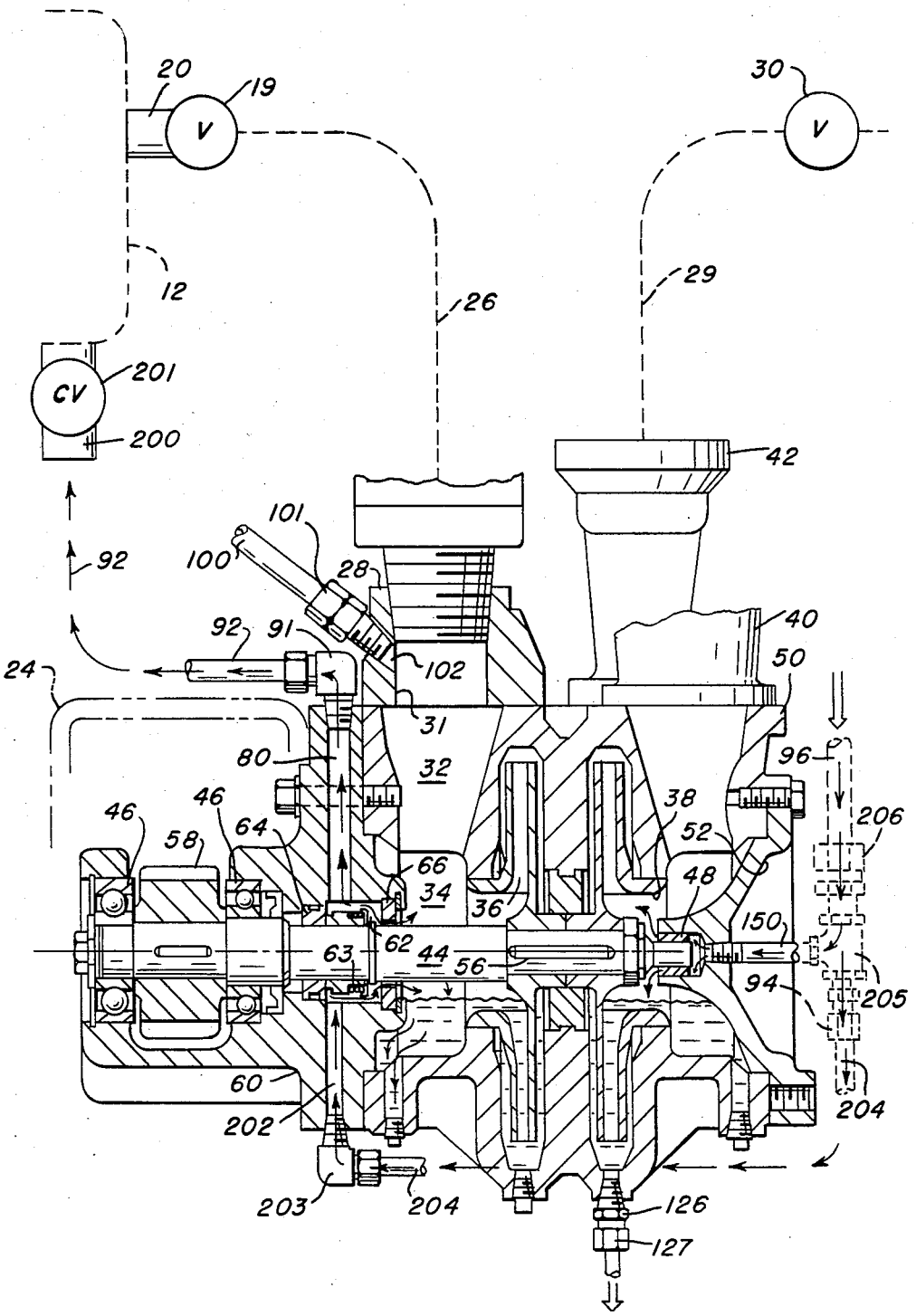
FIG. 3 is a partly diagrammatic view similar to FIG. 2 but showing the pumping system of the invention in the non-pumping mode.

Referring to FIGS. 2 and 3, the high pressure pump 22 of the pumping system of the invention is of the centrifugal type having an inlet provided by fitting 28 and an inlet passage 32 communicating at its downstream end with an inlet chamber 34 at the entrance to the first stage impeller 36 of a two stage impeller means for the high pressure pump 22. The exit from the first stage impeller 36 is connected to the entrance of a second stage impeller 38 by means of a U-shaped crossover tube 40. The exit from the second stage impeller 38 is by way of a discharge tube 42 which is in communication with the discharge line 29 having discharge valve 30 connected therein for controlling flow therethrough. In a typical fire fighting application the discharge line 29 is connected to a booster hose line coiled on a "live" booster reel, while discharge valves 15 and 17 are each connected to a 2½ inch fire hose.

As stated above, the main line 26 serves as a conduit means for delivering water from the discharge fitting 20 of the main pump 12 to the inlet of the high pressure pump 22. In accordance with the invention there is provided a flow control means which includes control valve 19 connected at outlet fitting 20 to control flow from the discharge of the main pump 12 through main line 26 to the inlet of the high pressure pump 22.

As best shown in FIGS. 2 and 3, the high pressure pump 22 comprises a pump shaft 44 rotatably supported at one end by a pair of bearings 46 in the gearbox 24 and extending through the high pressure pump body 50 to be supported at its outboard end in a sleeve bearing 48 contained in an end plate 52 forming part of the housing of the pump 22. Pump shaft 44 has the impellers 36 and 38 drivingly mounted thereon by means of a key 56. The portion of pump shaft 44 within the gearbox 24 has a gear 58 keyed thereon for causing rotation of the pump shaft 44. Gear 58 is driven by means of an intermediate gear (not shown) which is, in turn, driven by a sliding gear constructed and arranged to be driven from an engine-driven transmission of the fire truck as is conventional and well known in the art.

As is described in detail in said prior-mentioned patents, an adaptor 60 which forms part of the housing of the pump 22 mounts the pump 22 onto the gearbox 24 and defines a chamber 62 surrounding the pump shaft 44 at a location adjacent the inlet chamber 34. A mechanical seal is provided between pump shaft 44 and adaptor 60 to prevent the flow of water from chamber 62 to the exterior of the high pressure pump 22. This type of mechanical seal is well known in the art and is described in detail in said prior-mentioned patents. Briefly, the mechanical seal comprises a sealing element 63 mounted for rotation with shaft 44 to cooperate with a seat member 64 to seal the portion of shaft 44 extending from chamber 62 to the exterior of adaptor 60. A spring is positioned in compression between a spring holder and sealing element 63 to urge the same toward seat member 64. An orifice plate 66 is positioned to control flow between chamber 62 and the inlet chamber 34 as is shown in FIGS. 2 and 3. In accordance with the invention, conduit means are provided for connecting the chamber 62 to a portion of the suction of main pump 12. Such conduit means comprises a drilled hole 80 in adapter 60 communicating with chamber 62 and the exterior of the adapter 60 whereat a fitting 91 is connected. A pipe conduit 92 is connected between fitting 91 and a fitting 200 which is connected to a check valve 201 leading to the suction of main pump 12 as will be described more fully hereafter.

Figure 5:
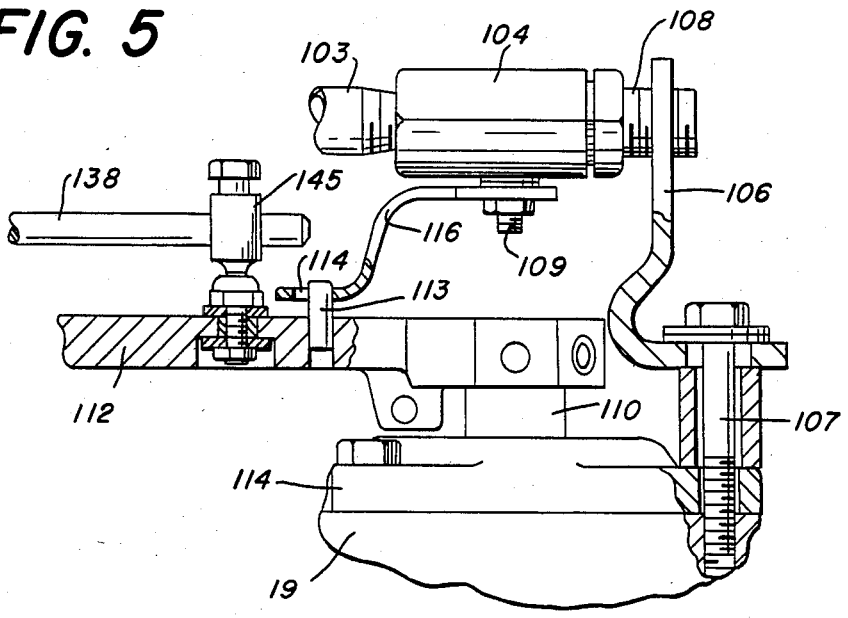
FIG. 5 is a fragmentary sectional view of a detail, i.e., the air valve and its support on the main control valve.

In accordance with a novel feature of the invention, there is provided means for introducing air into the inlet of the high pressure pump 22 for air binding the impeller means thereof in response to movement of the main control valve 19 to its closed flow control position. To this end, a conduit means in the form of an air bleed line 100 has one of its ends either closed or open to atmosphere and its other end communicating with the inlet of high pressure pump 22. To this end, one end of the air bleed line 100 connected to a fitting 101 secured on inlet fitting 28 of pump 22 and communicating with a passage 102 leading to a passage 31 within inlet fitting 28 communicating with the inlet passage 32. At its other end, the air bleed line 100 is connected to an elbow fitting 103 which is connected to an air valve 104 which is supported on a bracket 106 mounted on top of the main valve 19 by a mounting screw 107 as best shown in FIG. 5. Air valve 104 is a ball valve having a valve actuator shaft 109 and a flow nipple 108 which is threadedly secured in the upper end of the bracket 106 as shown in FIG. 5. Flow nipple 108 is open to atmosphere at its outer end and communicates with the valve chamber of air valve 104 on the upstream side of the valve member thereof, the downstream side of the valve member communicating with fitting 103. Air valve 104 is mounted to extend above the main valve 19 with its valve actuator shaft 109 approximately aligned with the axis of rotation of the valve actuator shaft 110 for the main valve 19 (See FIG. 5).

Figure 4:
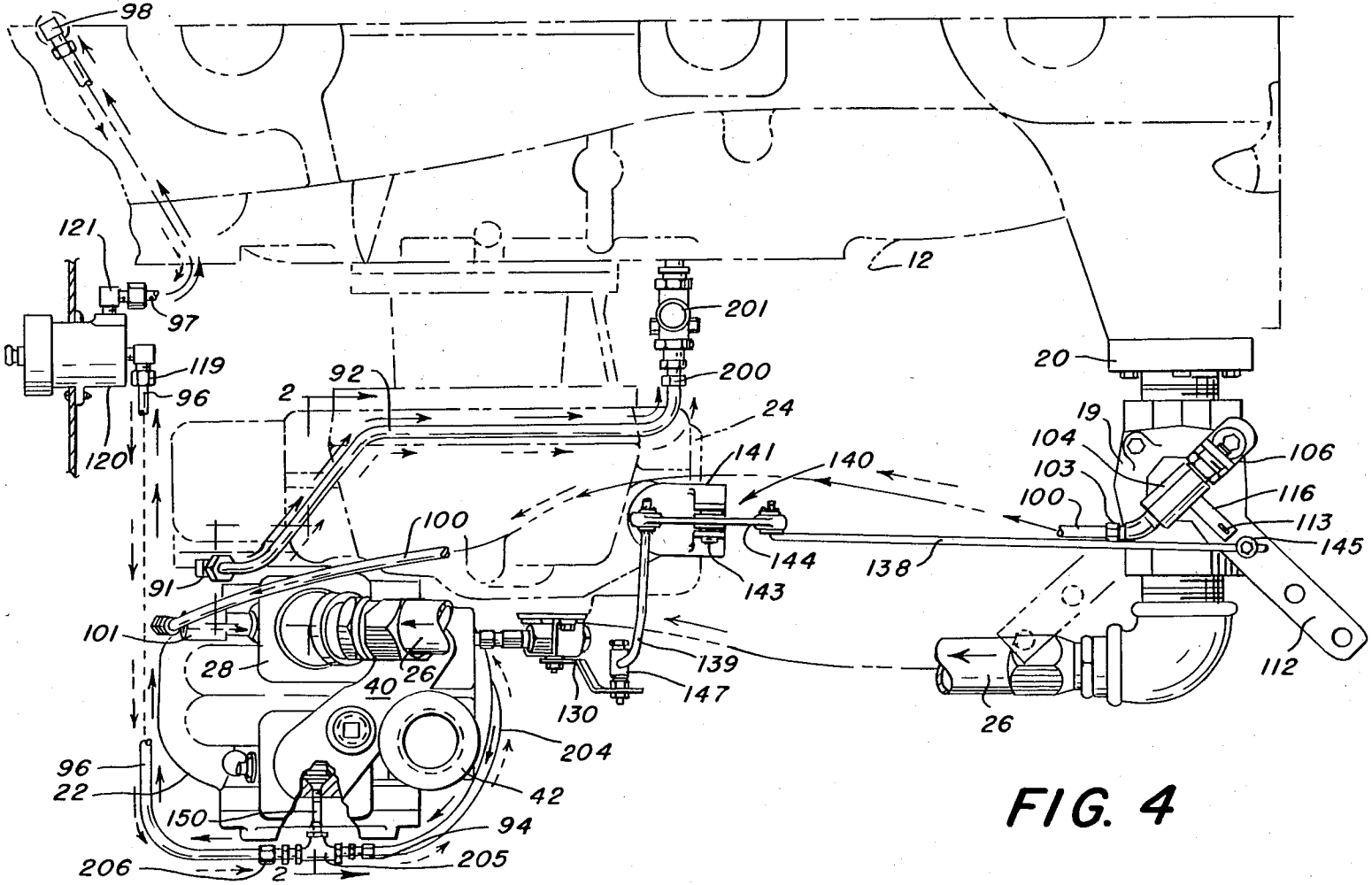
FIG. 4 is a top plan view of part of the pumping system in accordance with the invention.

The actuator shaft 110 extends upwardly from the main valve housing and has a handle assembly 112 secured thereto for rotating the valve actuator shaft 110 through ninety degrees between the solid and dashed line positions shown in FIG. 4. The handle assembly 112 is provided with a stop which projects downwardly therefrom in a location above the cover plate 114 for the main valve 19 so as to cooperate with stops thereon to limit the rotating movement of the handle assembly 112 as is conventional in the art. The parts are constructed and arranged such that the handle assembly 112 may be rotated through a ninety degree movement with the valve member of main valve 19 being moved between a fully opened position, the solid line position in FIG. 4, and a fully closed position, the dashed line position in FIG. 4.

The main valve 19 is movable between an open and a closed flow control position. In FIG. 2, the main valve 19 is shown in the open flow control position herein referred to as the ENGAGED position of high pressure pump 22. In FIG. 3, the main valve 19 is shown in the closed flow control position herein referred to as the disengaged position of high pressure pump 22.

While the main control valve 19 may be of various types, preferably this valve is of a type known in the art as a ball valve. In this type of valve, the valve member is an integral ball and shaft comprising a ball portion on an actuating shaft portion which extends upwardly through the valve cover for engagement with the handle assembly. The ball portion has a truncated hollow spherical configuration and includes a cylindrical internal flow passage adapted to be axially aligned with the direction of flow when the valve is open and to extend transversely thereto when the valve is closed.

Valve actuating means are provided to be responsive to the positioning of the handle assembly 112 in the ENGAGED control position to actuate the air valve 104 to its closed flow control position and to be responsive to the positioning of the handle assembly 112 in the DISENGAGED control position for actuating the air control valve 104 to its open flow control position whereby air is permitted to flow into the inlet of the high pressure pump 22 for air binding the impeller means thereof. Such means comprises a pin 113 mounted in the handle assembly 112 to project upwardly therefrom into a slot 114 formed in the free end of an arm 116 secured at its other end onto the valve actuating shaft 109 for the air valve 104. This arrangement is best shown in FIG. 5. The parts are constructed and arranged so that when the handle is rotated ninety degrees from the ENGAGED position (shown in solid lines in FIG. 4) to the DISENGAGED position (shown in dashed lines in FIG. 4) the arm 116 rotates the control shaft 109 for the air valve 104 approximately ninety degrees to move the air valve 104 from the closed position thereof to the open position thereof. When the air valve 104 is in the open position, air at atmospheric pressure flows through the nipple 108 past the air valve member to fitting 103 and through the air bleed line 100 and the fitting 101 to the inlet chambers 32 and 34 of the high pressure pump 22. This flow of air will occur since the pressure condition in the inlet chambers 32 and 34 of the high pressure pump 22 will be less than the atmospheric pressure externally of the air valve 104.

Figure 6:
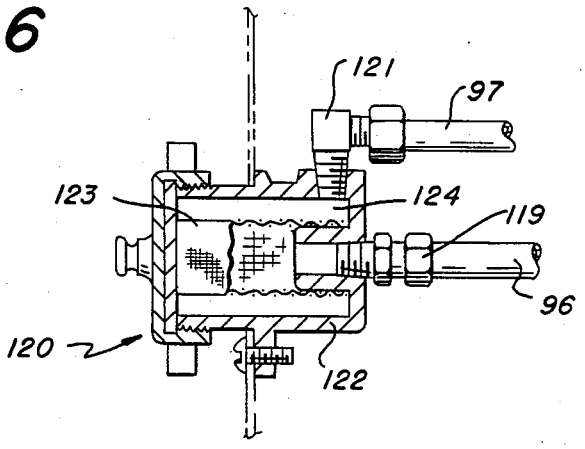
FIG. 6 is a sectional view of a detail, ie., the strainer assembly, of the pumping system in accordance with the invention.
Figure 7:
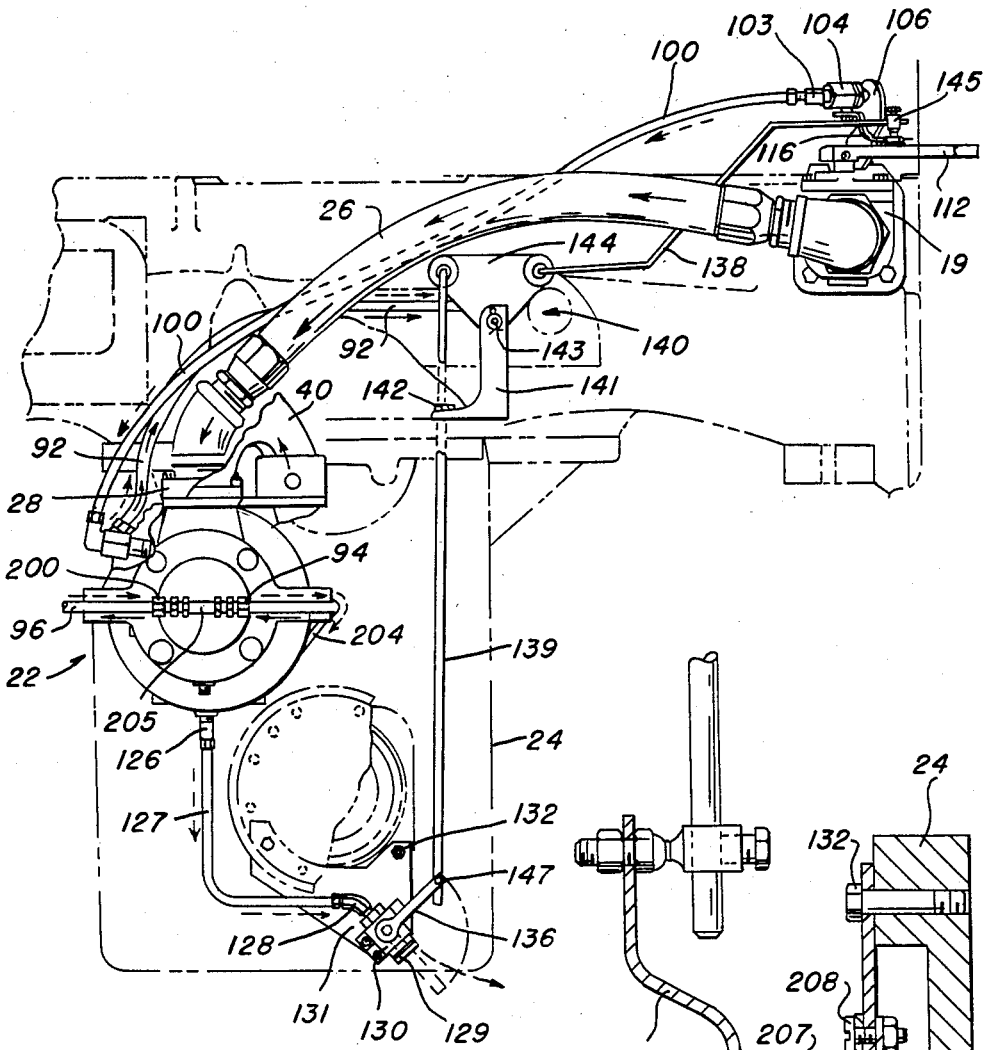
FIG. 7 is an elevational view of the part of the pumping system shown in FIG. 4.

The flow control means of the invention comprises means for causing liquid to flow across the mechanical seal when the main control valve 19 is in its DISENGAGED flow control position. Such means comprises the passage provided by drilled hole 202, the chamber 62 surrounding the mechanical seal and orifice plate 66 providing a flow orifice connected between chamber 62 and the inlet 34 to the impeller means. Such means also comprises conduit means connected at one end to the passage 202 in the adapter 60 and communicating at its other end to the discharge of the main pump 12. This conduit means is best shown in FIGS. 3, 4 and 7 and is comprised of a fitting 203 connected to adapter 60 in communication with passage 202. A tube 204 is connected between fittings 203 and 94. A tee fitting 205 is connected on one end to fitting 94 and on the other end to fitting 206. A tube 96 extends from fitting 206 to a fitting 119 on one side of a strainer assembly 120, and a tube 97 is connected between a pressure reducer fitting 121 on the other side of strainer assembly 120 and an elbow fitting 98 connected to the discharge of the main pump 12. As is best shown in FIG. 6, the strainer assembly 120 comprises a generally cylindrical body 122 containing cylindrical strainer screen 123 therein and having the fitting 119 communicating with the inside of the strainer screen 123, and pressure reducer fitting 121 connected to the annular chamber 124 externally of the strainer screen 123.

Figure 8:
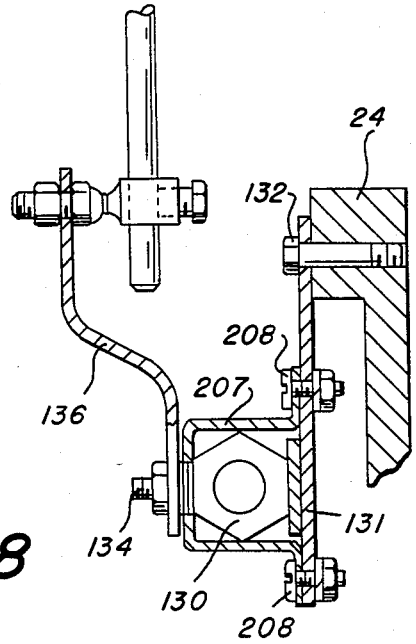
FIG. 8 is a fragmentary sectional view of a detail, i.e., the drain valve.

The flow control means in accordance with the invention also comprises means for draining liquid from the internal passages of the pump body of the high pressure pump 22. Such means comprises a fitting 126 which is mounted in the lower portion of the pump body to communicate with a passage leading to the lowest portion of the volute of the second impeller means 38 (See FIGS. 2 and 3). The fitting 126 has a tube 127 connected thereto which extends downwardly therefrom for connection to an elbow fitting 128 secured at one flow port of a drain valve 130. The drain valve 130 has a fitting 129 providing an outlet port which is open to atmosphere and is located at the lowest point of the pumping system. The drain valve 130 is mounted to bracket 131 by a clamp 207 and a plurality of bolts 208. This assembly is mounted on the gearbox 24 at the lower portion thereof by bolts 132 as shown in FIG. 8. The drain valve 130 is a conventional liquid flow control valve of the ball valve type and has its control shaft 134 secured to a handle 136 which is movable through a 90° movement between a closed position (as shown in solid lines in FIG. 7) and an open position (as shown in dashed lines in FIG. 7).

In accordance with the invention the flow control means includes means responsive to the positioning of the handle assembly 112 of the main valve 19 in its ENGAGED control position to actuate the drain valve 130 to its closed position and responsive to the positioning of the handle assembly 112 of the main valve 19 in its DISENGAGED control position for actuating the drain valve 130 to its open position. This actuating means comprises a pair of rods 138 and 139 and a pivoted crank assembly 140. The crank assembly 140 comprises a pivot 141 mounted on the gearbox 24 by mounting screw 142 and supporting a horizontally extending pivot pin 143. A triangular-shaped crank plate 144 is mounted for pivotal movement about the horizontal axis of pivot pin 143 at its one apex and is connected to the turned ends of the rods 138 and 139 at its other apexes as is best shown in FIG. 7. The end of rod 138 away from the crank plate 144 is secured to the handle assembly 112 at a swivel connection 145. The end of rod 139 away from crank plate 144 is connected to thehandle 136 of the drain valve 130 at a swivel connection 147 as is best shown in FIG. 8.

The rods 138, 139 and crank assembly 140 are constructed and arranged such that when the main valve handle assembly 112 is in the ENGAGED control position, the vertical rod 139 is held in an upward position by reason of the position of the horizontal rod 138 and crank plate 144 whereby the handle 136 of drain valve 130 is held in the upward or solid line position shown in FIG. 7 thereby closing drain valve 130, and when the main valve handle assembly 112 is moved to the DISENGAGED position, the horizontal rod 138 moves to the left as viewed in FIGS. 4 and 7 (to the dashed line position of FIG. 4) thereby pivoting the crank plate 144 in a counterclockwise direction (as viewed in FIG. 7) and moving the vertical rod 139 downwardly to position the handle 136 of the drain valve 130 in the downward or dashed line position shown in FIG. 7 to open the drain valve 130 and allow water to flow through the drain tube 127 from the internal passages of the high pressure pump 22.

In order to place the pumping system in the condition where the high pressure pump is in the pumping mode, the main valve handle assembly 112 is positioned by the operator to the "ENGAGED" position, which is shown in solid lines in FIGS. 4 and 7. This positions the main valve 19 in the open position whereby liquid flows from the discharge 20 of the main pump 12 through the main conduit 26 to the inlet 28 of the high pressure pump 22 to thereby pressurize the internal passages thereof. When the operator wishes to deliver liquid under high pressure from the high pressure pump 22, the discharge valve 30 is opened whereby water flows through the main conduit 26 through the high pressure pump 22 and through the discharge 42 thereof. This flow condition of the liquid is shown by the arrows in FIG. 2 from which it can be seen that liquid flows through the inlet 32 and inlet chamber 34 and through the two stage impellers 36 and 38 and out through the discharge 42. It is noted that in this condition of the pumping system, the air valve 104 is closed wherefore no air is bled into the inlet of the high pressure pump 22. Also, the drain line 130 is held closed by the position of the actuating rods 138, 139 and crank assembly 140 as described above. The flow condition of the valves and conduits when the flow control means is in the condition with handle assembly 112 in its ENGAGED position is shown by the solid line arrows in FIGS. 4 and 7.

In order to place the pumping system in the condition where the high pressure pump 22 is in the non-pumping mode, the operator manually moves the main valve handle assembly 112 to the DISENGAGED position shown in dashed lines in FIG. 4. By this simple manual actuating movement, the air valve 104 is opened by way of the connection through the pin 113 and arm 116, and the drain valve 130 is opened by way of the action of the rods 138, 139 and crank assembly 140 moving the handle 136 to the dashed line position shown in FIG. 7. When the various valves 19, 104, 130 are in the positions described above, the high pressure pump 22 is placed in a non-pumping mode and the pump flow is as shown by the arrows as shown in FIG. 3. Also, the flow condition of the valves and conduits of the flow control means with the parts in the DISENGAGED position is shown by the dashed line arrows of FIGS. 4 and 7. In this condition of the high pressure pump 22, there is no flow of liquid into the inlet 32 thereof because the main valve 19 is closed. However, the air bleed line 100 is open to atmosphere since the air valve 104 has been positioned in an open position. This allows air to flow through the bleed line 100 into the inlet of the high pressure pump 22 to air bind the impellers 36, 38 thereof. Thus, while the pump shaft 44 will continue to rotate along with the impellers 36, 38 keyed thereto, the impellers 36, 38 are incapable of pumping any liqud through the discharge tube 42 thereof. However, in accordance with the invention, means are provided for causing liquid to flow across the mechanical seal for cooling and lubricating the same. To this end, the liquid flows from fitting 98 (connected to the discharge of the main pump 12) through the tube 97, the pressure reducing fitting 121, the strainer assembly 1120, the tube 96, the fitting 206, the tee fitting 205, and fitting 94 connected to tube 204 connected to the fitting 203 connected to the passage 202 leading to the chamber 62 surrounding the mechanical seal. The liquid flow through pump 22 is as shown by the arrows in FIG. 3 and is through the passage 202, chamber 62 and through the annular orifice in the orifice plate 66 into the internal chambers of the pump 22. This liquid accumulates in the bottom of pump 22 and is drained from the pump by way of the drain line 127 and the drain valve 130 which is in the open position. Also if the pressure in chamber 62 is higher than the pressure in the suction chamber of the main pump 12 the check valve 201 will open and allow a portion of liquid to flow from chamber 62 through passage 80 connected to fitting 91, connected to tube 92, connected to fitting 200, connected to check valve 201 whose internal passage is in direct communication with the suction chamber of the main pump 12. However, if the pressure in the suction chamber of the main pump 12 is higher than the pressure in chamber 62 (i.e., operating from a positive pressure source such as a hydrant) the check valve 201 will remain closed.

Also, means are provided for causing liquid to flow through the sleeve bearing means 48 for cooling and lubricating the same when the high pressure pump 22 is in the non-pumping mode (the DISENGAGED position of the flow control means). Such means comprises a pipe conduit 150 which is connected between the tee fitting 205 and the end plate 52 of the pump housing. The flow is in the direction as shown by the dashed arrows in FIGS. 4 and 7 and the solid line arrows as shown in FIG. 3. Thus, the liquid flows from tee fitting 205 through the pipe conduit 150 and past the sleeve bearing 48 into the internal passages of the pump from which the liquid is drained by way of the drain line 127 as described above.

It will be apparent that various changes may be made in the construction and arrangement of parts without departing from the scope of the invention. For example the control valve could be an axial or push-pull type of control valve with lands that align and misalign to connect various flow lines simultaneously, or the control valve could be a rotary plug valve that turns 90° to align and misalign passageways to achieve the various flow control functions required.

What is claimed is:

1. In a liquid pumping system including
an engine,
a main pump having a plurality of discharges,
a high pressure centrifugal pump having a drive shaft and an impeller means mounted on said drive shaft,
drive means for driving both said main pump and said high pressure pump from said engine at the same time,
main conduit means connecting a discharge of said main pump to the inlet of said high pressure pump, and
valve means controlling the flow through the discharge of said high pressure pump,
the improvement comprising
flow control means including
a main control valve for controlling the flow through said main conduit means and being movable between an open flow control condition and a closed flow control position, and
means for selectively introducing air into the inlet of said high pressure pump for air binding said impeller means thereof when said main control valve is in said closed flow control position, said air binding rendering said high pressure pump incapable of pumping any liquid thereby eliminating the hydraulic horsepower requirement for said high pressure pump,
said means for selectively introducing air into the inlet of said high pressure pump comprising a second conduit means having its one end open to atmosphere and its other end communicating with the inlet of said high pressure pump, said flow control means including a second control valve for controlling flow through said second conduit means and being movable between an open flow control position in which air at atmospheric pressure is introduced into the inlet of said high pressure pump and a closed flow control position.

2. A pumping system according to claim 1 including manually operable means for moving said second control valve from said closed position to said open position whereby an operator can control when air is introduced into the inlet of said high pressure pump.

3. A pumping system according to claim 2 including means responsive to the movement of said main control valve to said closed flow control position thereof to move the second valve to said open flow control position thereof.

4. A pumping system according to claim 3 wherein said means responsive to the movement of said main control valve to said closed flow control position includes means interconnecting said main control valve and said second control valve.

5. A pumping system according to claim 1 including means responsive to the movement of said main control valve to said closed flow control position thereof to move said second valve to said open flow control position thereof.

6. A pumping system according to claim 5 wherein said means responsive to the movement of said main control valve to said closed flow control position includes means interconnecting said main control valve and said second control valve.

7. In a liquid pumping system including
an engine,
a main pump having a plurality of discharges,
a high pressure centrifugal pump having a drive shaft and an impeller means mounted on said drive shaft,
drive means for driving both said main pump and said high pressure pump from said engine at the same time,
main conduit means connecting a discharge of said main pump to the inlet of said high pressure pump, and
valve means controlling the flow through the discharge of said high pressure pump,
the improvement comprising
flow control means including
a main control valve for controlling the flow through said main conduit means and being movable between an open flow control condition and a closed flow control position, and
means for introducing air into the inlet of said high pressure pump for air binding said impeller means thereof when said main control valve is in said closed flow control position thereby eliminating the hydraulic horsepower requirement for said high pressure pump,
said means for introducing air into the inlet of said high pressure pump comprising a second conduit means having its one end open to atmosphere and its other end communicating with the inlet of said high pressure pump, said flow control means including a second control valve for controlling flow through said second conduit means and being movable between an open flow control position and a closed flow control position, said flow control means including a manually operable control handle movable between an engaged and disengaged control position, valve actuating means responsive to the positioning of said handle in said engaged control position to actuate said main control valve to its open flow control condition and said second control valve to its closed flow control condition and responsive to the positioning of said handle in said disengaged control position for actuating said main control valve to its closed flow control position and said second control valve to its open flow control position whereby air is permitted to flow into the inlet of said high pressure pump for air binding said impeller means thereof.

8. A pumping system according to claim 7 including a conduit means for draining liquid from the internal passages of said pump body, said flow control means including a third flow control valve for controlling flow through said draining conduit, and means responsive to the positioning of said control handle to said engaged control position to actuate said third control valve to a closed position thereof and responsive to the positioning of said control handle to said disengaged control position for actuating said third control valve to an open position thereof.

9. A pumping system according to claim 7 wherein said high pressure pump includes a pump body and said drive means includes a drive gear means engaged with said drive shaft of said high pressure pump, and including a seal means for sealing said drive shaft located between said impeller means and said drive gear means, and means for causing liquid to flow across said seal when said control handle is in said disengaged position including first passage means in said body of said high pressure pump connected between the exterior of said body and said seal means, second passage means in said pump body connected between said seal and the internal flow passages of said pump body, and means for draining liquid from the internal flow passages of said pump body.

10. A pumping system according to claim 9 wherein said means for causing liquid to flow across said seal includes a conduit connected at one end to the first passage means at the exterior of said pump body and communicating at its other end with a portion of the discharge of said main pump.

11. A pumping system according to claim 7 including bearing means for supporting the outboard end of said drive shaft of said high pressure pump and means for causing liquid to flow through said bearing means when said control handle is in said disengaged control position thereof including passage means in said pump connected between the exterior of said pump and said bearing means, conduit means delivering liquid from a discharge connection of said main pump to said passage means, and conduit means for draining liquid from the internal passages of said pump body.

12. A pumping system according to claim 11 including a third flow control valve in said draining conduit means controlling flow therethrough, and means responsive to the positioning of said control handle in said engaged control position to actuate said third control valve to a closed position and responsive to the positioning of said control lever in said disengaged control position for actuating said third control valve to an open position.

13. In a liquid pumping system including
an engine,
a main pump having a plurality of discharges,
a high pressure centrifugal pump having a drive shaft and an impeller means mounted on said drive shaft,
drive means for driving both said main pump and said high pressure pump from said engine at the same time,
main conduit means connecting a discharge of said main pump to the inlet of said high pressure pump, and
valve means controlling the flow through the discharge of said high pressure pump,
the improvement comprising
flow control means including
a main control valve for controlling the flow through said main conduit means and being movable between an open flow control condition and a closed flow control position, and
means for introducing air into the inlet of said high pressure pump for air binding said impeller means thereof when said main control valve is in said closed flow control position thereby eliminating the hydraulic horsepower requirement for said high pressure pump said high pressure pump including a pump body and said drive means includes a drive gear means engaged with said drive shaft of said high pressure pump, and including a seal means for sealing said drive shaft located between said impeller means and said drive gear means, and means for causing liquid to flow across said seal when said main control valve is in said closed flow control position including first passage means in said body of said high pressure pump connected between the exterior of said body and said seal means, second passage means in said pump body connected between said seal and the internal flow passages of said pump body, and means for draining liquid from the internal flow passages of said pump body.

14. In a liquid pumping system including an engine, a main pump having a plurality of discharges, a high pressure centrifugal pump having a drive shaft and an impeller means mounted on said drive shaft, drive means for driving both said main pump and said high pressure pump from said engine at the same time, main conduit means connecting a discharge of said main pump to the inlet of said high pressure pump, and valve means controlling the flow through the discharge of said high pressure pump, the improvement comprising flow control means including a main control valve for controlling the flow through said main conduit means and being movable between an open flow control condition and a closed flow control position, and means for introducing air into the inlet of said high pressure pump for air binding said impeller means thereof when said main control valve is in said closed flow control position thereby eliminating the hydraulic horsepower requirement for said high pressure pump, bearing means for supporting the outboard end of said drive shaft of said high pressure pump and means for causing liquid to flow through said bearing means for cooling and lubricating said bearing means when said main control valve is in said closed flow control position thereof including passage means in said pump body connected between the exterior of said pump body and said bearing means and conduit means for delivering liquid from a discharge connection of said main pump to said passage means, and means for draining liquid from the internal passages of said pump body.

* * * * *